US006726423B2

(12) United States Patent
Hocking

(10) Patent No.: US 6,726,423 B2
(45) Date of Patent: Apr. 27, 2004

(54) METHOD AND APPARATUS FOR BINDING A PLURALITY OF SHEETS

(75) Inventor: Harold P. Hocking, Manhattan Beach, CA (US)

(73) Assignee: Powis Parker Inc., Berkeley, CA (US)

( * ) Notice: Subject to any disclaimer, the term of this patent is extended or adjusted under 35 U.S.C. 154(b) by 0 days.

(21) Appl. No.: 09/849,933

(22) Filed: May 7, 2001

(65) Prior Publication Data

US 2002/0164229 A1 Nov. 7, 2002

(51) Int. Cl.[7] ..... B42C 11/00

(52) U.S. Cl. ..... 412/1; 412/9; 412/4; 412/8; 412/36; 412/37; 412/900

(58) Field of Search ..... 412/1, 4, 8, 9, 412/36, 33, 900, 902, 14

(56) References Cited

U.S. PATENT DOCUMENTS

| | | | | |
|---|---|---|---|---|
| 3,715,260 A | | 2/1973 | Dornemann et al. | 156/477 B |
| 4,126,982 A | * | 11/1978 | Ito et al. | 53/593 |
| 4,496,617 A | | 1/1985 | Parker | 428/55 |
| 4,898,506 A | | 2/1990 | Lázár | 412/8 |
| 5,052,873 A | | 10/1991 | Parker et al. | 412/13 |
| 5,066,183 A | | 11/1991 | Tholérus | 412/4 |
| 5,174,556 A | * | 12/1992 | Taylor et al. | 270/1.1 |
| 5,193,962 A | | 3/1993 | Parker et al. | 412/8 |
| 5,346,350 A | | 9/1994 | Luhman et al. | 412/37 |
| 5,452,920 A | | 9/1995 | Parker | 281/21.1 |
| 5,569,011 A | * | 10/1996 | Yamaguchi et al. | 412/9 |
| 5,601,915 A | | 2/1997 | Ochi et al. | 428/323 |
| 5,613,711 A | | 3/1997 | Parker | 281/21.1 |
| 5,829,938 A | | 11/1998 | Hartwig et al. | 412/8 |
| 5,833,423 A | | 11/1998 | Yamaguchi et al. | 412/8 |
| 5,997,964 A | | 12/1999 | Klima, Jr. | 428/1 |
| 6,024,525 A | | 2/2000 | Yamanaka | 412/36 |
| 6,056,493 A | | 5/2000 | Hartwig et al. | 412/8 |
| 6,065,884 A | | 5/2000 | Parker et al. | 400/611 |
| 6,155,763 A | | 12/2000 | Parker et al. | 412/6 |

OTHER PUBLICATIONS

Pub. No. US 2002/0131847 A1, Parker, Pub. Date Sep. 19, 2002.
Pub. No. US 2002/0064437 A1, Kuramoto et al., Pub. Date May 30, 2002.
Pub. No. US 2002/0067977 A1. Cobene, II et al., Pub Date Jun. 6, 2002.
Pub. No. US 2002/0106264 A1, Cobene, II et al., Pub Date Aug. 8, 2002.

* cited by examiner

*Primary Examiner*—Willmon Fridie, Jr.
(74) *Attorney, Agent, or Firm*—Girard & Equitz LLP

(57) ABSTRACT

A method for binding together a plurality of paper sheets. The binding process comprises providing a book binding sheet coated on one side with hot-melt adhesive, orienting and securing sheets of paper that will comprise the book to be bound relative to the binding sheet, securing the leading edge of the binding sheet to the front of the book to be bound, severing the secured portion from the remaining binding sheet material, wrapping the binding severed strip around the spine and rear cover and heating the adhesive to produce a permanent bond with the edges of the spine and covers.

14 Claims, 8 Drawing Sheets

METHOD AND APPARATUS FOR BINDING A PLURALITY OF SHEETS

BACKGROUND OF THE INVENTION

1. Field of the Invention

The present invention provides a method and apparatus for binding a plurality of sheets together using a hot-melt adhesive, the adhesive being formed on a continuous roll of binding material. The sheet includes a resistive strip along the tail end of the roll for identifying the physical characteristics of the roll. The resistive strip is also used to indicate to the apparatus when the roll is consumed and needs to be replaced.

2. Description of the Prior Art

Techniques for binding sheets of material, such as paper, in a manner to form books have been widely available in the prior art. For example, U.S. Pat. Nos. 5,829,938 and 6,056,493 to Hartwig et al (the inventor of the present invention is a co-inventor on both the '938 and '493 patents) disclose a specific book binding apparatus using a L-shaped tape. Although the '938 and '493 patents disclose a useful book binding apparatus, the apparatus is relatively expensive to fabricate due to the number of mechanical components required. In addition, separate L-shaped binding tapes are utilized to bind sheets together.

U.S. Pat. No. 4,898,506 to Lázár discloses a bonding system for securing a hot-melt strip material to an overlying sheet material and a grooving system for grooving the sheet material adjacent the opposite side edges of the strip material after it has been secured to the sheet. This patent is directed to a method and apparatus for producing the binding strips themselves, not a method for applying binding strips to sheets of paper. In addition, the above noted prior art patents do not disclose a technique wherein the binding material itself indicates to the processing apparatus, the physical characteristics thereof or, in the case of the Lázár patent, an indication when the roll is at the tail end.

What is thus desired is to provide an improved method and apparatus for binding together a plurality of sheets and wherein the binding material roll includes means for indicating to the binding apparatus the physical characteristics of the material and when a replacement roll is required.

SUMMARY OF THE PRESENT INVENTION

The present invention provides a method and apparatus for binding together a plurality of paper sheets. The binding process comprises providing a roll of book binding material coated on one side with hot-melt adhesive, orienting and securing sheets of paper, rear cover and spine that will comprise the book to be bound relative to the binding material, securing the leading edge of the binding material to the front of the book to be bound, severing the secured portion from the remaining binding material, wrapping the binding severed strip around the spine and rear cover and heating the adhesive to produce a permanent bond with the edges of the spine and covers. The binding material includes a strip of resistive material formed near the tail end of the roll to identify its physical characteristics to the microprocessor utilized in the apparatus. In addition to providing identification of the physical characteristics (this information is always available whenever the machine is turned on regardless of the amount of material consumed previously), the resistive strip applied to the binding material is physically wrapped around the core of the roll in such a way that when the material on the roll is consumed, the resistive strip becomes disconnected from the conductive edges of the core thus indicating to the microprocessor that the roll should be replaced to prevent partial or incomplete binding of the last document.

The present invention thus provides an improved book binding apparatus that is more automated and faster than prior art book binding machines.

BRIEF DESCRIPTION OF THE DRAWINGS

For a better understanding of the present invention as well as other objects and further features thereof, reference is made to the following description which is to be read in conjunction with the accompanying drawing therein.

DESCRIPTION OF THE INVENTION

Figure 1:
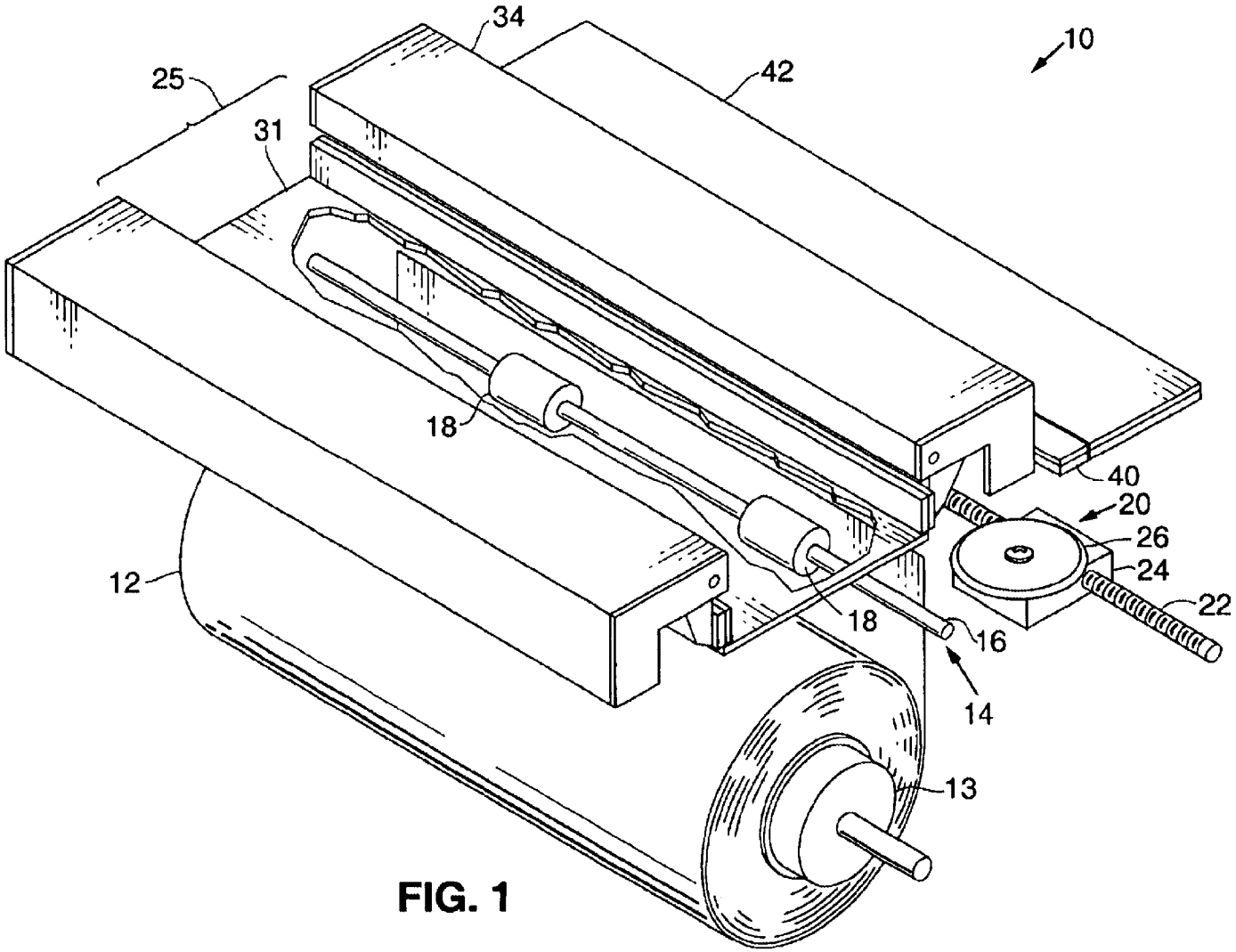
FIG. 1 is a simplified partial exploded perspective view of the book binding apparatus of the present invention.
Figure 2:
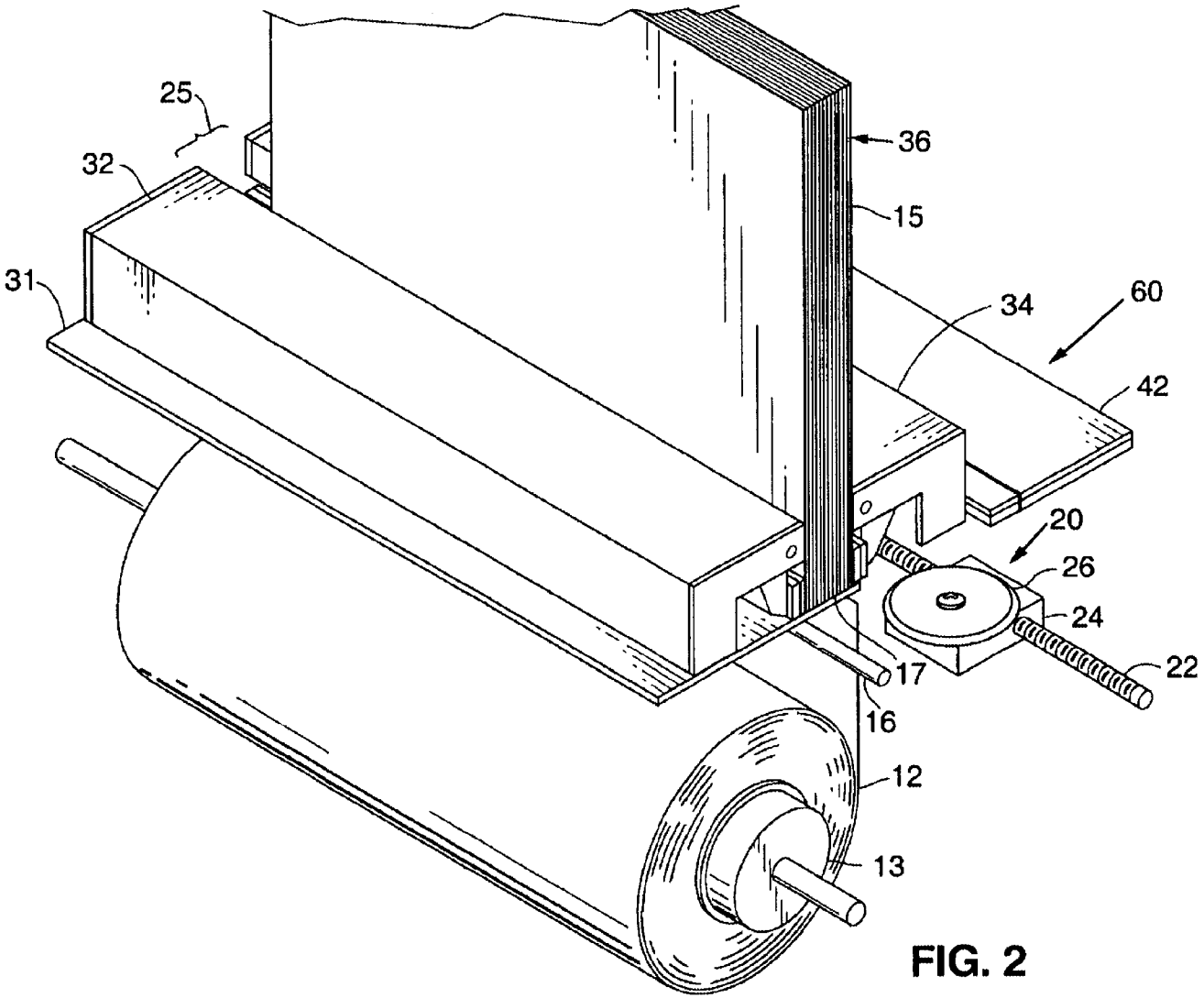
FIGS. 2–7 illustrate the steps for binding a plurality of paper sheets together to form a book.

Referring now to FIGS. 1 and 2, the book binding apparatus 10 of the present invention is illustrated.

Binding machine roll 12 comprises a conventional continuous length binding sheet coated with hot-melt glue adhesive formed on one surface wound on a spindle 13. Roll 12 is selected to be the width of the pages to be bound together avoiding the need to be cut or trimmed along the width dimension. Accordingly, for a standard 8½×11 inch page or a standard A4 (8.27×11.69 inches) page, the width of the roll would be 11 and 11.69 inches, respectively. A tape feed roller system 14 comprising driver shaft 16 and rollers 18 advances the binding roll 12 in discrete increments in order to position the binding material precisely along the lower edge of the front cover of the block of pages 36 to be bound. Cutter 20, comprising leadscrew 22, driver 24 and knife 26, is positioned to sever a precise length from the binding material roll 12 necessary to wrap around the book spine 27, the length of the cut strip portion being dependent on the number and thickness of the sheets presented into the binding cavity 25 for binding. Cutter 20 is advanced by control mechanism 24 across the entire width of the binding material 12, severing a binding strip 29 (FIG. 4) from the rest of the roll 12. A paper shelf 31 is located at the bottom of binding cavity 25 and provides a flat smooth plenum surface along which the pages to be bound are accumulated arid aligned prior to binding. The binding cavity 25 supports the sheets while they are accumulated prior to binding and is surrounded by perpendicular surfaces used to align the edges of the sheets as will be set forth hereinafter.

Figure 9:
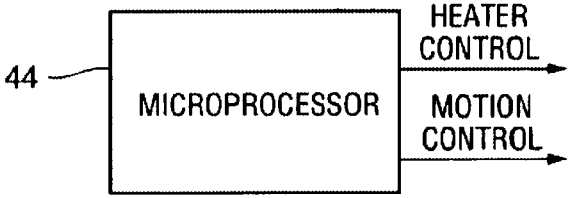
FIG. 9 is a block diagram of a microprocessor used to control various functions of the subject book binding apparatus.

The opening of binding cavity 25 is flanked on two sides by clamps 32 and 34, the clamps securing the sheets after the edges are aligned to maintain the alignment during the binding process. Clamps 32 and 34 are adjacent the lower edge of the block of pages 36 to be bound to secure the block as well as the corners. The lower edges of clamps 32 and 34 are mounted in a way as to allow them to be rotated out of the way during the binding process without disturbing the alignment of the clamped block of pages 36. Three heaters 38, 40 and 42 (FIG. 3) are positioned to heat the three adjacent surfaces to which binding strip 29 is to be applied (heater 38 is formed on the lower edge 39 of clamp 34). Each heater is regulated independently by a conventional microprocessor 44, (FIG. 9), allowing heat to be applied at the appropriate time and also controlling the temperature and pressure required to apply the binding strip 29 to the front and back edges and to the spine of the block of sheets 36 during the binding process. The use of heaters to heat and melt the adhesive to bind the book pages is conventional and is not, by itself, a part of the present invention and the use of microprocessor 44 to provide the signals to control the heaters 38, 40 and 42, the cutter 20 and other components are also well known and not part of the present invention.

Referring to FIG. 2, the process is initiated when the pages 36 are introduced into the binding cavity 25. These may be assembled outside the binding cavity 25 and introduced as a block of pages, the likely case if used manually to bind sheets into books. The sheets may also be introduced into the binding cavity individually until the complete set is accumulated; typically the case if apparatus 10 was integrated with a printer or copier producing sheets one at a time and delivering them to binding cavity 25. The edges of the sheets in binding cavity 25 are aligned either manually or by means of the clamps 32 and 34. After the complete set of sheets, including front and rear covers are assembled, the next step is to clamp the sheets together.

Figure 3:
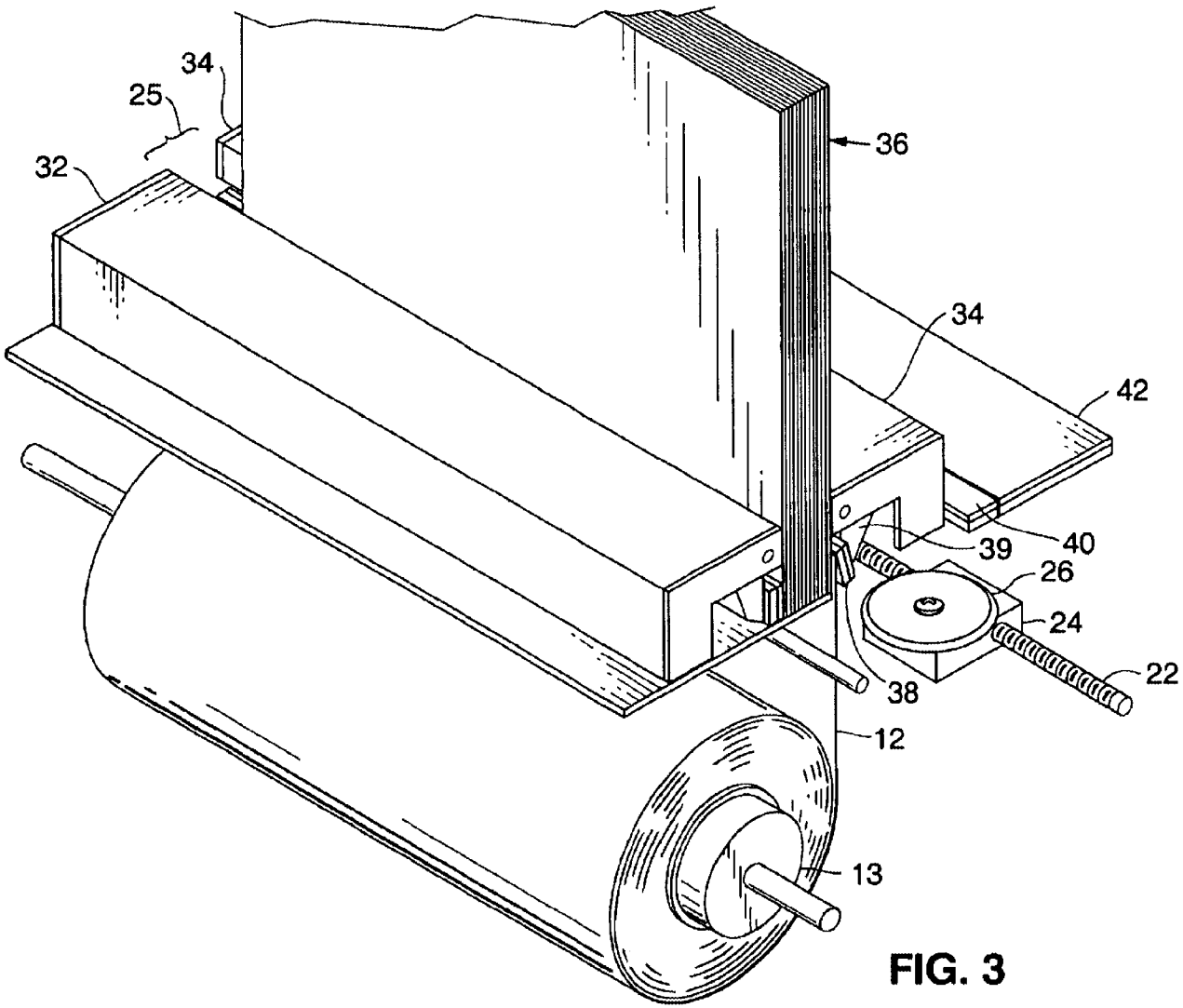

During the clamping step, the block of sheets 36 is positioned to align with the binding material roll 12 as shown in FIG. 3. The lower edge 39 of clamp 34 is rotated out of the way and the feed rollers 14 and 18 advance the binding roll 12 to the prescribed location along the front edge, or front cover, 15 of the block of sheet 36.

Figure 4:
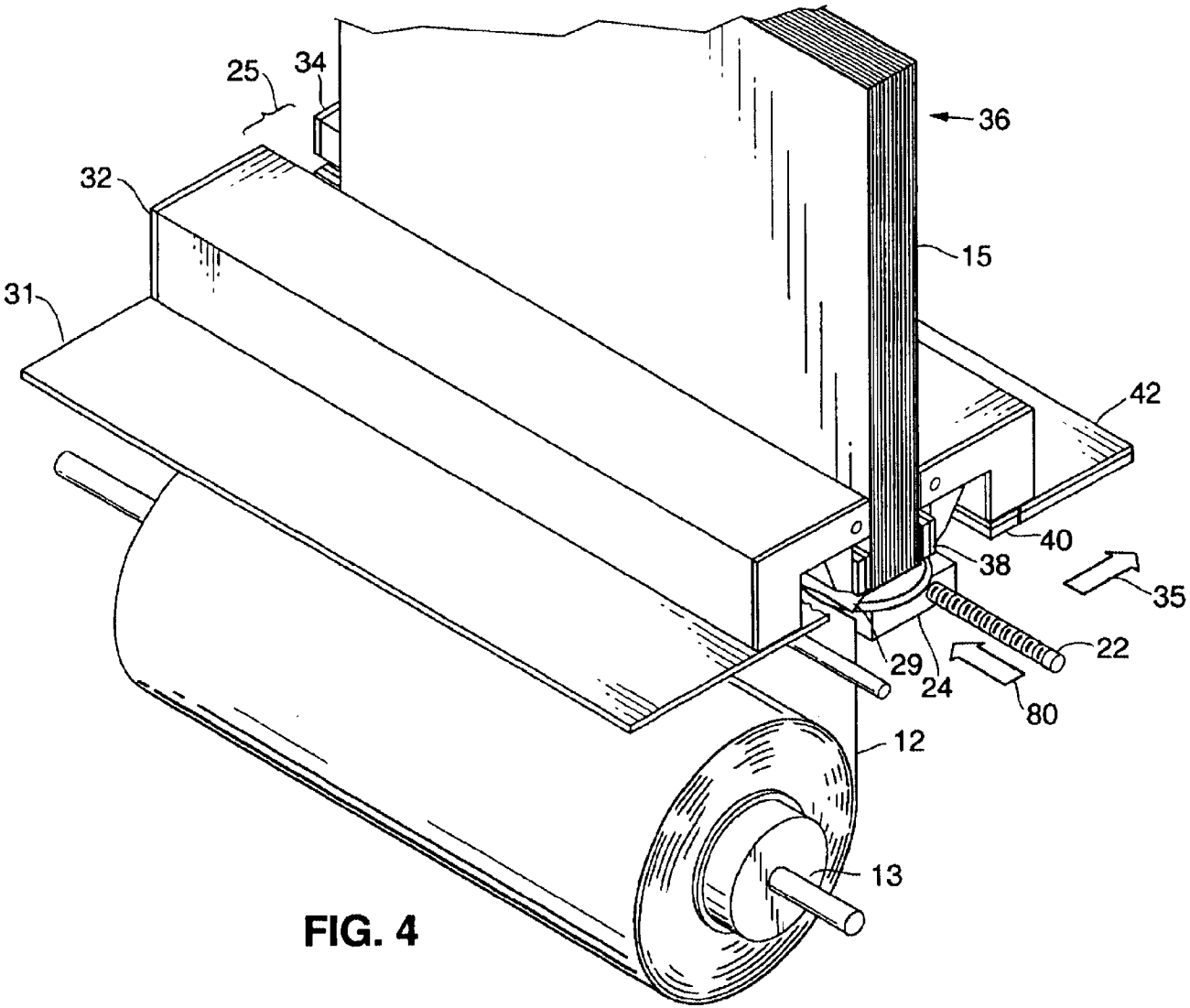

With the binding roll 12 in position along the lower edge of the front of the block of sheets 36, heater 38 is brought to bear against the binding sheet portion 27, applying heat and pressure to secure it to the front cover 15 as shown in FIG. 4.

After the leading edge of the binding sheet portion 29 is secured to the front cover 15 and while maintaining the integrity of the block pages 36, the block 36 is moved to the right as shown in FIG. 4, in the direction of arrow 35, drawing out a prescribed amount of sheet 29 proportional to the thickness of the block of pages while wrapping the sheet 29 around the spine portion 17 of the block 36. At the predetermined position, knife 20D is transported along the lateral width of the sheet 29 in the direction of arrow 80 severing it from roll 12.

Figure 5:
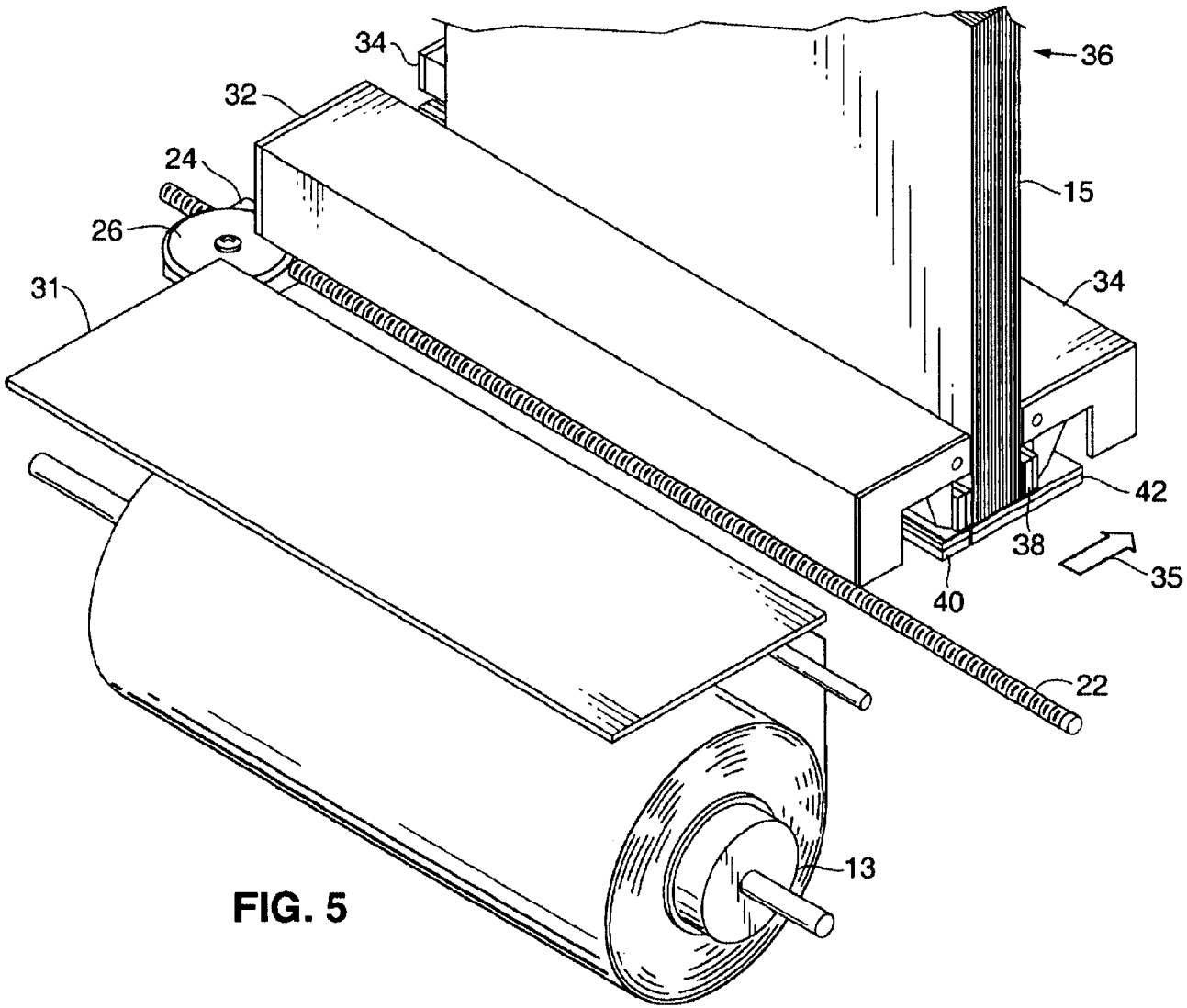

The block 36 and sheet portion 29 are transported further in the direction of arrow 39 and positioned over spine heater 40 as shown in FIG. 5. Heat and pressure are then applied to the spine portion 17 of the block of sheets 36 causing the sheets to be bonded together by the liquefied hot-melt glue on sheet portion 29. At this step, two of the three sides of block 36 are now adhered into position.

Figure 6:
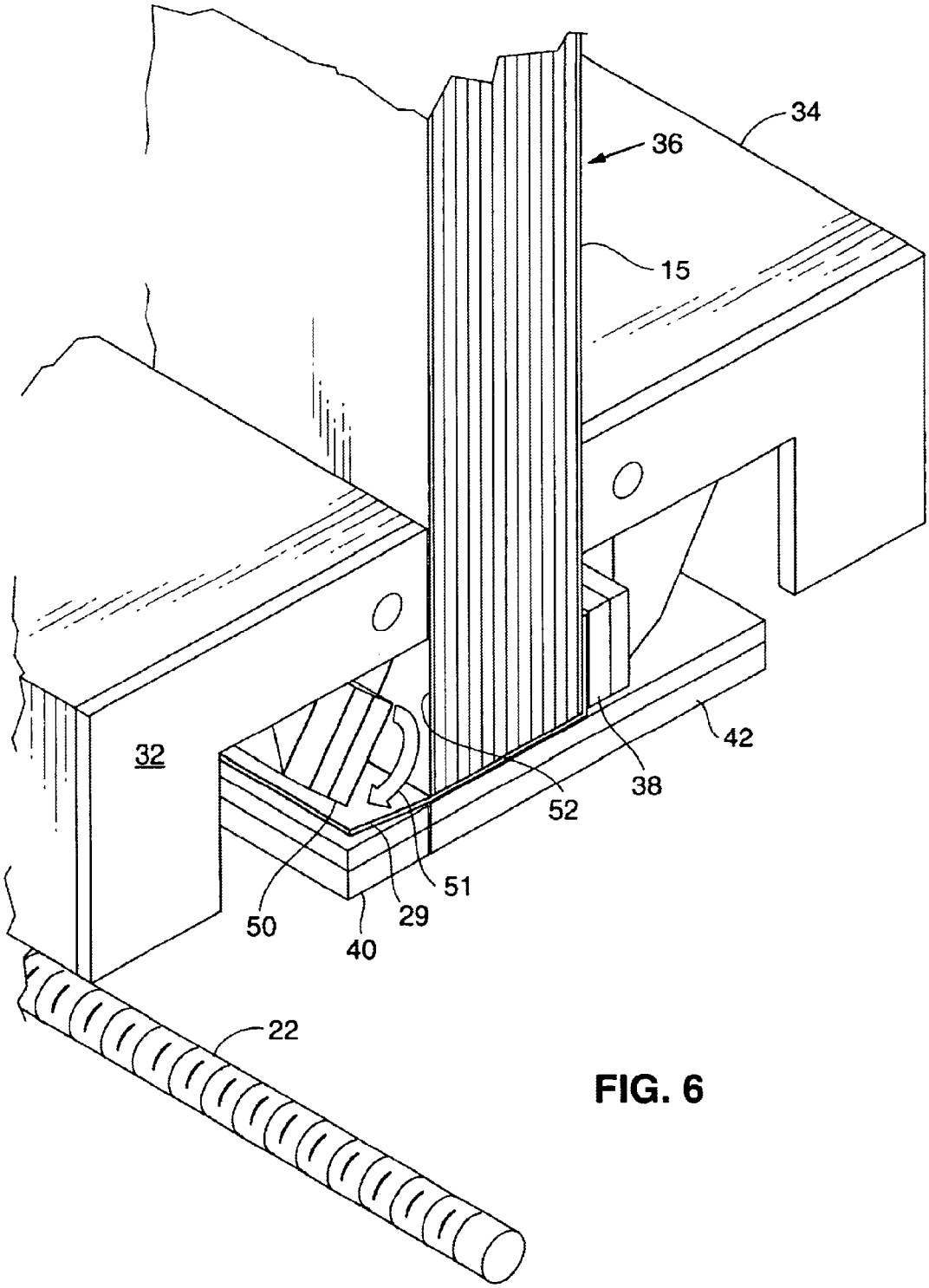
Figure 7:
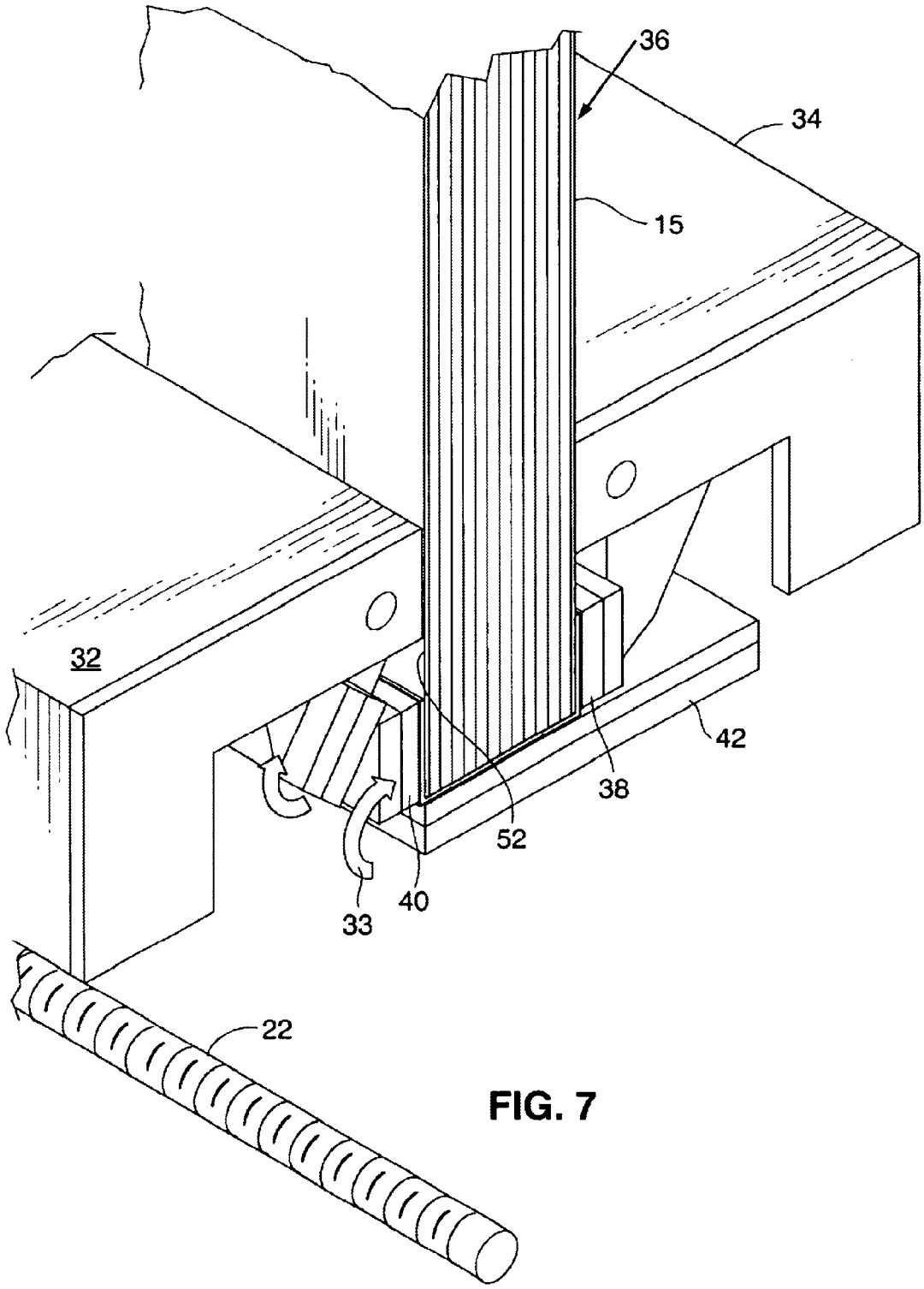

With the block of sheets 36 positioned to the right of the axis of rotation of heater 40, the lower edge 50 of clamp 32 is rotated out of the way in the direction of arrow 51 as shown in FIG. 6. Heater 40 is then rotated clockwise in the direction of arrow 53 wrapping the protruding portion of the binding strip portion 29 around the back cover 52 of the block of sheets 36 as shown in FIG. 7. Heat and pressure are again applied to secure the last portion of the strip portion 29. All three surfaces of the binding strip 29 are secured for a period of time sufficient to insure good binding results.

The bound document is then transported back to the original starting position over the paper shelf 31 (transport mechanism is not shown but is of a conventional design) in the direction of arrow 60 as shown in FIG. 2 and allowed to cool sufficiently.

After cooling, the clamps 32 and 34 are moved apart in the direction of arrow 62 and the finished bound document is removed from binding cavity and the process is ready to start over.

Figure 8:
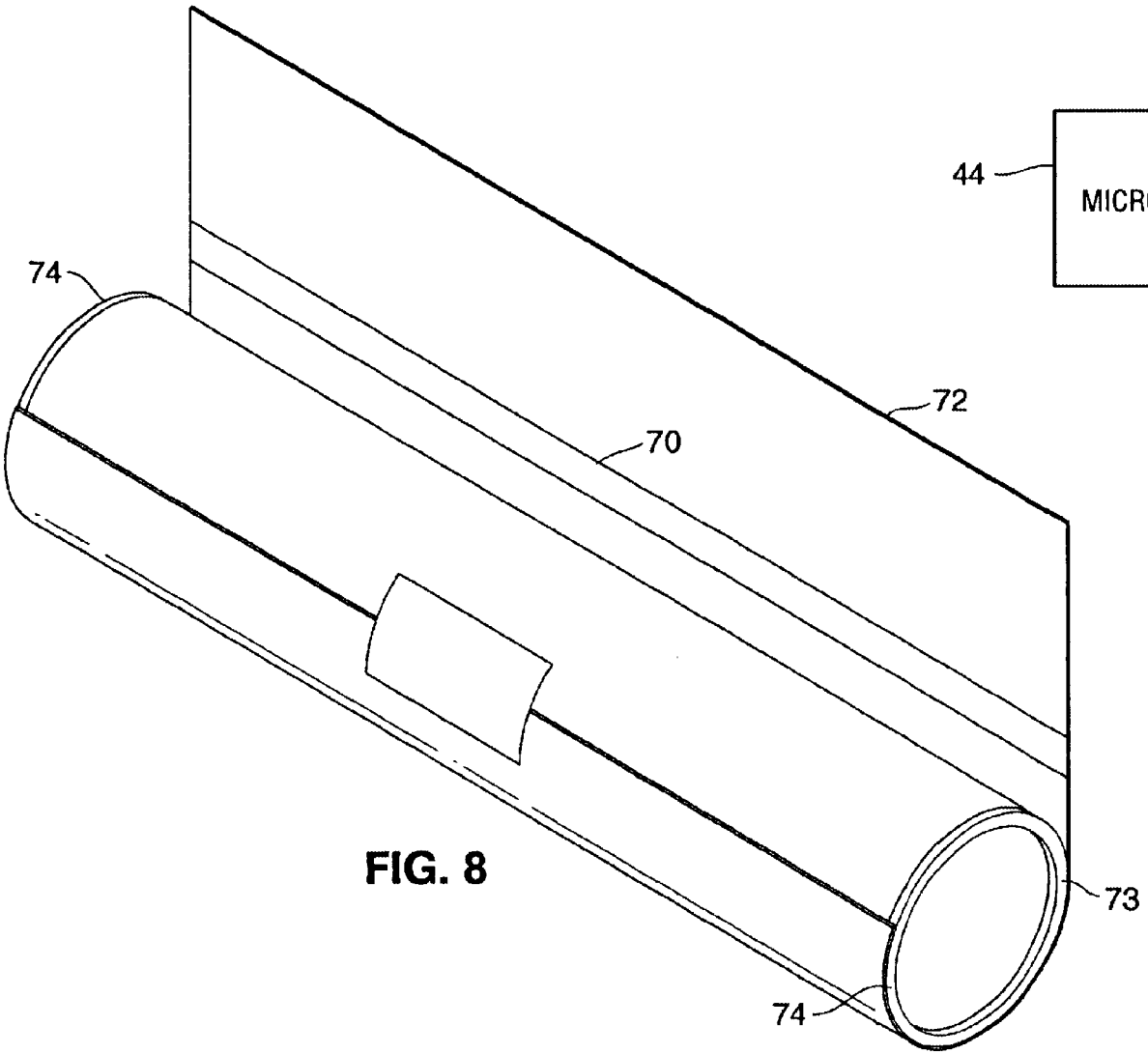
FIG. 8 illustrates the novel binding material roll of the present invention.

FIG. 8 illustrates a binding material roll 12 in accordance with the teachings of the present invention. Roll 12 includes a strip of resistive material 70 formed on the inner surface 72 of the roll near the tail end (the resistive strip 70 applied to the binding material is physically wrapped around the inner core 73 of the roll 12 as illustrated). Resistive strip 70 has a resistance value coded to correspond to the physical characteristics of the roll itself, i.e. the type of paper, the width of the roll, the heating levels required to melt the adhesive coating, etc. Sensors on the spindle 13 detect the resistance level and couple the information to microprocessor 44 which in turn controls the apparatus components.

When the material on the roll is consumed, the resistive strip 70 becomes disconnected from the conductive edges 74 of the core 73, exposing the conductive edges 74 on spindle 13. This condition is detected by sensors (not shown) which then generate a signal indicating that no further binding can take place until the roll is replaced, thus preventing partial or incomplete binding of the last block of pages. Microprocessor 44, in response to this signal, essentially turns the apparatus off. When the roll is replaced, microprocessor 44 turns the apparatus on.

The present invention thus provides a new and improved book binding method that is more automated and faster than book binding apparatus currently available.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A method of making a book having a plurality of sheets and a front cover comprising a continuous roll of binding material positioned on a spindle member, one surface of the binding material being coated with a heat softened adhesive on one surface and a resistive strip formed on the binding material, the width of the material equal to the width of the sheets to be bound together comprising the steps of:

advancing the binding material into position adjacent said pages;

securing said binding material to the edge of said front cover of the block of sheets to be bound;

controlling the amount of binding material withdrawn from said roll of binding material after being secured to the edge of said front cover so it is proportional to the thickness of the block of sheets to be bound;

separating a portion of said binding material from the rest of the binding material roll after it has been secured to said front cover edge; and sensing said resistive strip and producing a signal in response to the sensing.

2. The method of claim 1 wherein a book cover and spine member portion are included as part of said book.

3. The method of claim 1 wherein said portion of said binding material is selectively heated on three surfaces to insure the appropriate binding conditions required to secure said front cover.

4. The method of claim 1 wherein the spindle member includes at least one electrical contact which is coupled to the resistive strip and wherein the sensing includes sensing the resistive strip by way of the at least one electrical contact.

5. Apparatus for making a book having a plurality of sheets and a front cover which form a block of sheets using a continuous roll of binding material positioned on a spindle member, one surface of the binding material being coated with a heat softened adhesive on one surface, with a resistive strip being formed on the binding material and the width of the binding material equal to the length of an edge of the block of sheets to be bound together, said apparatus comprising:

means for advancing the binding material into position adjacent said block of sheets;

means for securing said binding material to the edge of said front cover of the block of sheets to be bound;

a microprocessor for controlling the amount of binding material withdrawn from said roll of binding material after being secured to the edge of said front cover so it is proportional to the thickness of the block of sheets to be bound;

a cutter for separating a portion of said binding material from the rest of the binding material roll after it has been secured to said front cover edge; and a sensor configured to detect the resistive strip when the roll of binding material is installed in the apparatus.

6. The apparatus of claim 5 wherein a book cover and spine member portion are included as part of said book.

7. The apparatus of claim 5 further including means for selectively heating said binding portion on three surfaces to insure the appropriate binding conditions required to secure said front cover, said spine member and said back cover.

8. The apparatus of claim 5 wherein said spindle member has a conductive member formed thereon and wherein the sensor is positioned to engage the conductive member.

9. The method of claim 8 further including means for detecting said conductive member when the roll of said conductive member is substantially depleted from said spindle member.

10. Apparatus for binding a stack of sheets at an edge of the stack of sheets, said apparatus comprising:

receiving means for receiving a quantity of binding material, with the binding material including an elongated substrate and an adhesive layer disposed on the substrate, with the binding material being wound around a spindle member to form roll so that a major axis of the substrate is normal to an axis of the spindle member and a width of the substrate corresponding to the length of the edge of the stack to be bound, with the spindle member including a pair of electrical contacts, disposed at respective opposite ends of the spindle member, which provide an electrical path through a resistive layer on a first section of the binding material when the first section of the binding material is wound around the spindle member and which do not provide an electrical path through the resistive segment when the first section in not wound around the spindle member;

a sensor to be coupled to the electrical contacts of the roll of binding material and configured to provide a signal indicative of a state of the electrical path;

control means for controlling operation of the binding apparatus in response to the signal;

means for supporting the stack to be bound so that the edge of the stack to be bound is parallel to the spindle member when the binding material is disposed in the receiving means;

means for unrolling the binding material from the spindle member and applying a section of the binding material to the edge of the stack being bound; and means for cutting the binding material along a path normal to the major axis of the binding material.

11. The apparatus of claim 10, wherein the resistive layer has a resistance magnitude that varies depending upon a type of the binding material and wherein the sensor means further includes means for detecting the resistance magnitude.

12. A binding material assembly to be used to bind a stack of sheets along an edge of the stack of sheets, said assembly comprising:

an elongated substrate having a major axis along the length of the substrate and a width equal to the length of the edge of the stack to be bound;

an adhesive layer formed on a surface of the substrate;

a spindle member around which the substrate is wound to form a roll so that the major axis of the substrate is normal to an axis of the spindle member;

a resistive segment disposed across the width of the substrate on a first portion of the substrate; and electrical contacts at opposite ends of the spindle member and positioned to engage the resistive segment when the first portion of the substrate is wound around the spindle member and to not engage the resistive segment when the first portion of the substrate is unwound from the spindle member.

13. The binding material assembly of claim 12, wherein the substrate has a width that is substantially equal to a dimension selected from the group consisting of 11.0 inches and 11.69 inches.

14. Apparatus for binding a stack of sheets comprising:

a quantity of binding material having an elongated substrate and a layer of heat activated adhesive disposed on the substrate;

a resistive segment disposed on a portion of the binding material across a width of the substrate;

a spindle member around which the binding material is wound so that a major axis of the binding material along length of the substrate is normal to an axis of the spindle member;

a pair of electrical contacts disposed at opposite ends of the spindle member so as to make electrical contact with the resistive segment when the portion of the binding material is wound around the spindle member and to break electrical contact with the resistive segment when the portion of the binding material is unwound from the spindle member;

means for supporting the stack of sheets to be bound;

a sensor coupled to the pair of electrical contacts for producing a signal indicative of a resistance between the pair of electrical contacts;

means for supporting the spindle member so that the spindle member is generally parallel to an edge of the stack to be bound;

means for applying the binding material to the edge of the stack to be bound; and means for cutting the binding material along a path parallel to the edge of the stack to be bound.

* * * * *

UNITED STATES PATENT AND TRADEMARK OFFICE

CERTIFICATE OF CORRECTION

PATENT NO. : 6,726,423 B2
DATED : April 27, 2004
INVENTOR(S) : Harold P. Hocking It is certified that error appears in the above-identified patent and that said Letters Patent is hereby corrected as shown below:

Column 5,
Line 59, "in" should be deleted and replaced with -- is --.

Signed and Sealed this

Sixth Day of July, 2004

JON W. DUDAS
*Acting Director of the United States Patent and Trademark Office*